US005606847A

United States Patent [19]

Joensson et al.

[11] Patent Number: 5,606,847

[45] Date of Patent: Mar. 4, 1997

[54] METHOD AND DEVICE FOR FILLING AND CLOSING A PACKAGE

[75] Inventors: Leif T. Joensson, Rydebäck; Ake Rosén, Helsingborg, both of Sweden

[73] Assignee: Tetra Laval Holdings & Finance S.A., Pully, Switzerland

[21] Appl. No.: 481,304

[22] PCT Filed: Jan. 14, 1994

[86] PCT No.: PCT/EP94/00100

§ 371 Date: Jun. 30, 1995

§ 102(e) Date: Jun. 30, 1995

[87] PCT Pub. No.: WO94/16949

PCT Pub. Date: Apr. 8, 1994

[30] Foreign Application Priority Data

Jan. 20, 1993 [CH] Switzerland ..... 00166/93

[51] Int. Cl.[6] ..... B67B 3/28

[52] U.S. Cl. ..... 53/471; 53/478; 53/487; 53/268; 53/281; 53/298; 53/329.5

[58] Field of Search ..... 53/478, 487, 471, 53/329.3, 329.5, 281, 268, 296, 297, 298

[56] References Cited

U.S. PATENT DOCUMENTS 3,491,510 1/1970 Sternau ..... 53/329.5
4,599,851 7/1986 Williams ..... 53/487
5,054,265 10/1991 Perigo et al. ..... 53/471
5,272,854 12/1993 Ye et al. ..... 53/329.5

FOREIGN PATENT DOCUMENTS 405112317 5/1993 Japan ..... 53/329.5

*Primary Examiner*—John Sipos
*Assistant Examiner*—John Paradiso
*Attorney, Agent, or Firm*—A. Ray Osburn

[57] ABSTRACT

A method for filling and closing a package which is initially open on its upper side and has sealable plastic material about the periphery (2) of that side. The package is first conveyed to a location (6), where it is filled. Thereafter, a covering foil sheet (12) is sealed to periphery (2) to cover the open side. The package is brought to a standstill at the filling location (6), and filled through an opening (11) in a strip of the covering foil (7). The strip of covering foil (7) is then moved in a direction (10) lateral to the direction of conveyance (5) of the package, until the open side of package (1) is covered by the foil strip (7). A foil cover piece is then punched from the foil strip (7), leaving a new opening (11), and is sealed to the periphery (2) of the open side of the package (1). The sealed package (1) is then moved from filling location (6) by the conveyor belt (4). The strip of covering foil (7), with the new opening (11), remains stationary until the filling and sealing operation upon the next package (1).

13 Claims, 3 Drawing Sheets

METHOD AND DEVICE FOR FILLING AND CLOSING A PACKAGE

Figure 1:
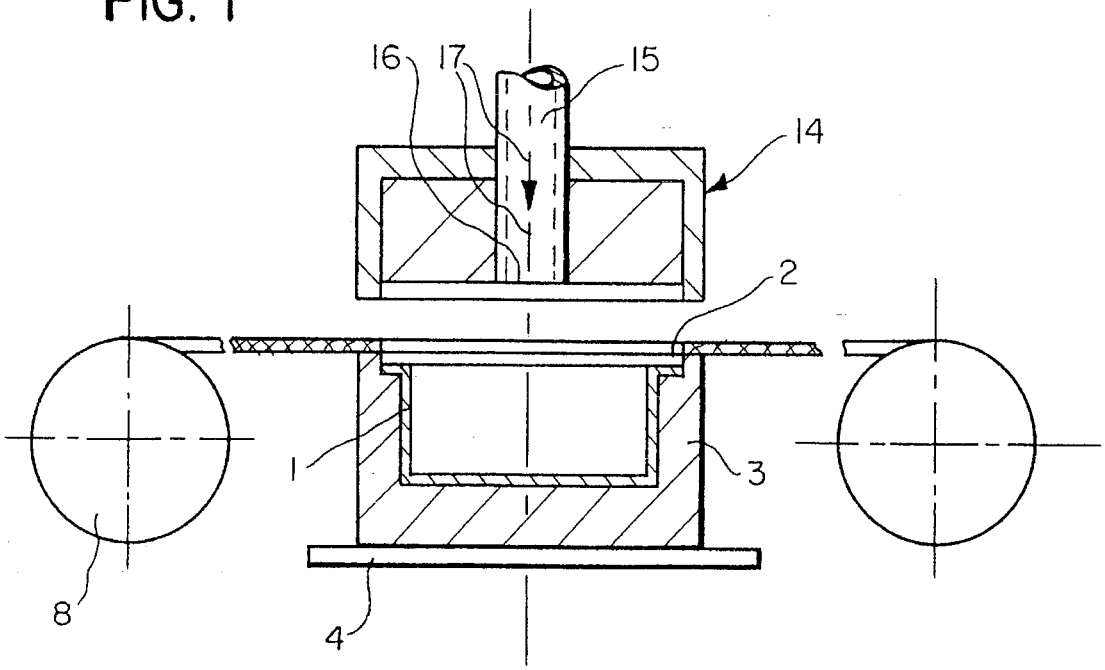

The invention relates to a method for filling and closing a package open on one side, which is provided, at least on its edge which is to be closed, with sealable plastics material, in which the package is conveyed intermittently in a first direction of conveyance, is filled at a filling point, and thereafter a covering foil is placed on the edge and sealed thereto.

For filling and closing margarine or yoghurt packages it is known to fill packages having one edge made of plastics material and to convey them to a closure point where a covering foil of plastics material or metal or a multilayered covering foil is sealed thereto.

It has been shown in the case of high capacity machines that the packages just filled and not yet closed have to be greatly accelerated to achieve a large number of pieces per unit of time with the disadvantage that as a result contents slop out or splash out.

The object of the invention is to provide and to effectively improve a method of the type presently described, which significantly reduces and preferably indeed prevents the risk of splashing of contents during filling and closure of the packages despite high output.

This object is solved according to the invention in that the package is brought to a complete standstill in the filling point, wherein in the filling point a hole in a web of covering foil is arranged at a height above the package, in that during this complete standstill of the package and the web of covering foil the package is filled through this hole, the web of covering foil is moved forwards in a second direction at an angle with respect to the first direction of conveyance over the conveyor belt until the entire opening, including the edge of the package, is covered by the covering foil material, and after punching out of a covering foil this is sealed onto the edge of the package still during the complete standstill, after which the package is moved further along the conveyor belt, while the web of covering foil remains at a standstill. The essential feature of the invention is that the package is brought to a complete standstill, during which the package is filled and subsequently closed. Only after closure of the package is it accelerated and moved further along in the said first direction of conveyance. Acceleration of the unclosed but already filled package is advantageously impossible according to the invention. In this way the risk of splashing is eliminated in a surprising manner. A device operating according to such a method can thus be set up for a correspondingly high capacity.

The further essential concept of a solution according to the invention is in the web of covering foil moved at an angle with respect to the first direction of conveyance, which is moved independently of the package and relatively with respect thereto. A hole is arranged in the web of covering foil and this hole is placed over the open side of the package to be filled, whereafter the said complete standstill begins. On commencement thereof the package can be and is filled from above through the hole. While the filled package remains stationary, the web of covering foil is moved along until there is no hole or recess present over the opening of the package to be closed, but instead covering foil material covers over the entire package, including the edge of the package. Then, still during the complete standstill of the package, a stamping device is set in motion which punches out the covering foil, which in the course of said motion is sealed to the edge of the package shortly afterwards. Only now is the complete standstill time ended and the package can be moved further in the said first direction of conveyance after initial acceleration with the aid of the conveyor belt. The contents can no longer slop over the edge of the package.

In addition it is particularly advantageous when according to the invention the hole in the web of covering foil is formed by the punching out of a covering foil. It has presently been described with respect to the forward movement of the web of covering foil after filling of the package, that no opening remains over the upwardly open package, but rather covering foil material covers over the entire upper side of the package. After this the punching out of the covering foil is carried out. By means of this punching out procedure a hole is made in the web of covering foil, the external dimensions of which correspond to those of the covering foil. As a result the punching out of the covering foil can be assumed at the same time to be the formation of the hole. Then advantageously after punching out and sealing on of the covering foil the web of covering foil does not have to be moved further along until the filling procedure of the next following package is completed. In this way not only time but also material in the web of covering foil is saved.

It is furthermore advantageous when according to the invention a lid is additionally placed on the filled package already closed with the covering foil, by means of which the edge of the package is significantly and advantageously stiffened. Although it is already known to close packages of a similar type with a lid, the timing speed was until now greatly reduced because of the risk of splashing after filling. The thickness of the material of the web of covering foil is so small, for example the thickness is in a range of between 0.1 mm to 0.5, that practically one can hardly speak of a notable use of material. The amount of time necessary for placing this covering foil is also so small that it can practically be ignored in the course of the all of the steps of the method. Consequently, the result remains the filling of a package and closure with the stiffened lid as previously according to the state of the art, however with the great difference that the risk of splashing is significantly reduced if not prevented by means of the described and surprising measures without extra expenditure. Although the stiffened lid is only fitted mechanically, there is a fluid sealing capability which can be modified by using an appropriate covering foil to even give a gas sealing capability.

The invention also relates to a device for filling and closing a package of the type described by means of the application of a covering foil which is to be sealed to the edge and is sealable therewith, and this device is provided with holders for receiving and conveying the package in a first direction of conveyance below a filling point with a filler pipe moveable in a third, vertical direction. In order to provide this device with the advantageous properties of high capacity and of the device taking up as small an amount of space as possible, and to improve the device so that the risk of splashing is almost or if possible completely avoided, according to the invention it is provided that a web of covering foil material is provided which can be moved intermittently in the area of the filling point from a first roller to a second roller in a second direction of movement at an angle to the first direction of conveyance, above the conveyor belt at approximately the height of the top edge of the holder, and that a stamping and sealing tool is arranged in the area of the filling point. The actual effect of the device with these features according to the invention is mainly directed to the area of the filling point in which the conveyor belt is crossed by the web of covering foil such that the web of covering foil passes over the conveyor belt at the height described, that is to say at approximately the height of the top edge of the holder, as in the latter the packages open on one side are located which stand on the conveyor belt and have to be closed from above by the covering foil. The movement of the web of covering foil is also intermittent as is that of the conveyor belt. Preferably, both stop simultaneously in the area of the filling point so that the essential working procedures can be carried out there.

According to the present description, the main part of the operation is the filling of the package by means of a vertically moveable filler pipe which is lowered down into the open package before filling and is raised during filling until the filling procedure ends and the package is filled to the necessary filling level, and thereafter the filler pipe is raised yet further in the third, vertical direction. The further task and effect of the device in the area of the filling station is the cutting out or punching out of the covering foil from the web, a procedure which is carried out by the stamping and sealing tool, which is advantageously also arranged in the area of the filling station in order to avoid longer conveyancing distances.

In a further configuration of the invention it is provided that the filler pipe is arranged within the effective area of the stamping and sealing tool and moveable relatively with respect thereto and that the drives for the moveable parts are synchronously matched to each other. The punching out and sealing is mainly carried out in the edge area of the product, that is to say of the package to be filled. The opening present inside the edge of the package is the effective area of the tool, and this is large enough also to receive a filler pipe which can moved up and down in the said third, vertical direction within a frame-like stamping and sealing tool. The tool also only needs to move down and up again in this third, vertical direction for the punching out; and it behaves in the same manner during the sealing procedure. If the package to be filled is thus at a complete standstill and already in the correct location within the filling point, the individual tools then have only to move in a short path down and up again in the third, vertical direction in order to carry out all the work and to completely demonstrate the desired effect. The matching of the drives for the moveable parts is provided such that the steps of the method described in the introduction are carried out at the correct time intervals: firstly arrangement of the web of covering foil with the hole formed therein in the area of the filling point; filling of the package; forward movement of the web of covering foil until the opening of the package is covered; punching out of the sufficiently large covering foil; sealing of the same to the top edge of the package; withdrawal of all tools and therewith opening of the sealing tool; and further movement of the filled and closed package to the next processing point.

It is advantageous according to the invention when the holder and the conveyor belt are composed of steel, and preferably the first direction of conveyance is perpendicular to the second direction of movement of the web of covering foil. It is advantageous to hold the packages which are to be filled and are open on one side, which are for example configured in a cup-shaped manner and composed entirely of plastics material, in storage in a magazine. These packages are placed one by one in steel holders and in this way are held in a stable and defined manner. When the conveyor belt is also composed of steel the precise arrangement of the packages or of their edges can be retained under the processing tools (for filling, punching out, sealing). Any elongation tolerances due to tensile forces within the conveyor belt between the individual holders is thereby largely eliminated. Short and precise movements are achieved particularly well when the first direction of conveyance of the conveyor belt with the holders is perpendicular with respect to the second direction of movement of the web of covering foil.

It is further advantageous according to the invention when—seen from the point of view of the first direction of conveyance—a lid fitting point is arranged at a distance beyond the filling point. In the filling point the covering foil is sealed on according to the invention and the package thereby protected from the risk of splashing, and by means of the arrangement of a lid fitting point next to the filling point there is practically no additional space requirement in comparison with conventional devices, and nevertheless lids—where appropriate also present in a magazine and pre-prepared—can be pressed and fixed by means of a clamping or snap action onto the top edge of the filled package with the result that the package processed according to the invention has a very stiff external edge.

Even when the package which is filled and processed using the measures according to the invention is started up with high acceleration and transported with conveyor belts, there is no longer any risk of splashing because of the covering foil. The entire machine can be configured very compactly and yet have a high capacity. In this way it is possible to arrange several production lines adjacently to one another, wherein the machine is very flexible. According to the wishes of a client a machine can be built with just a few or where appropriate with many production lines for setting up the required capacity. In practical operation it has been shown that in production using three lines 4,500 packages per hour can be filled and sealed in the manner described.

Figure 2:
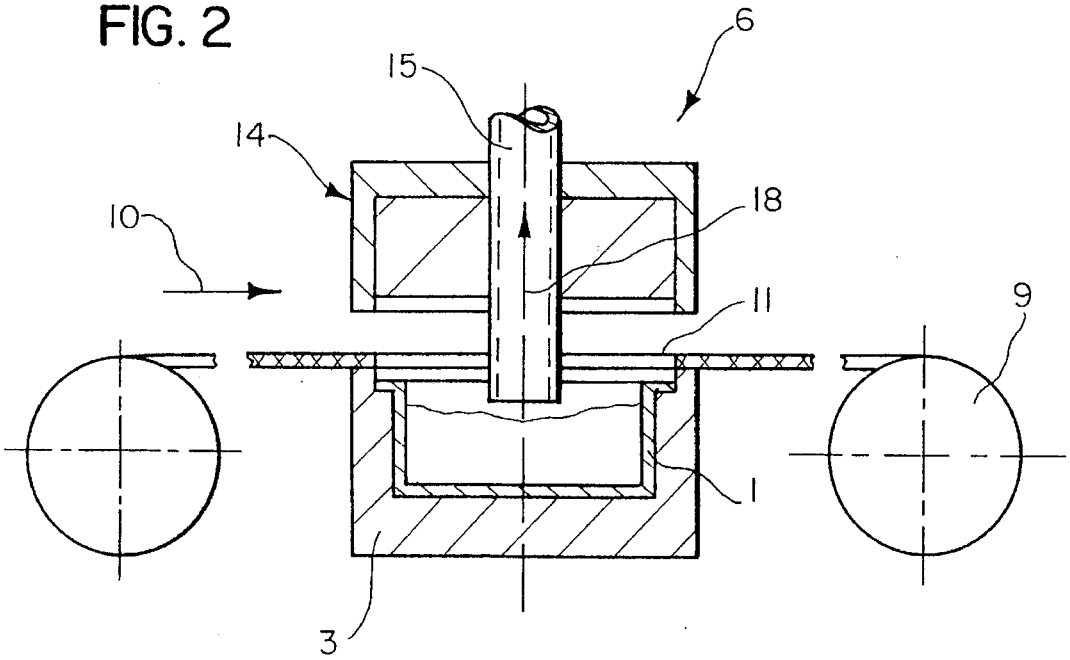
Figure 4:
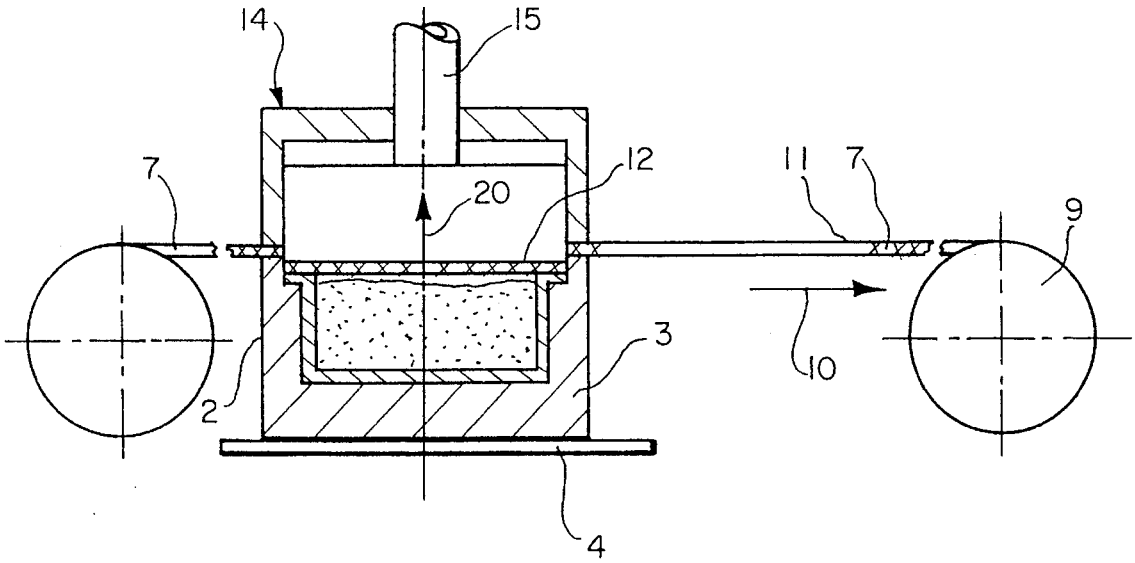
Figure 5:
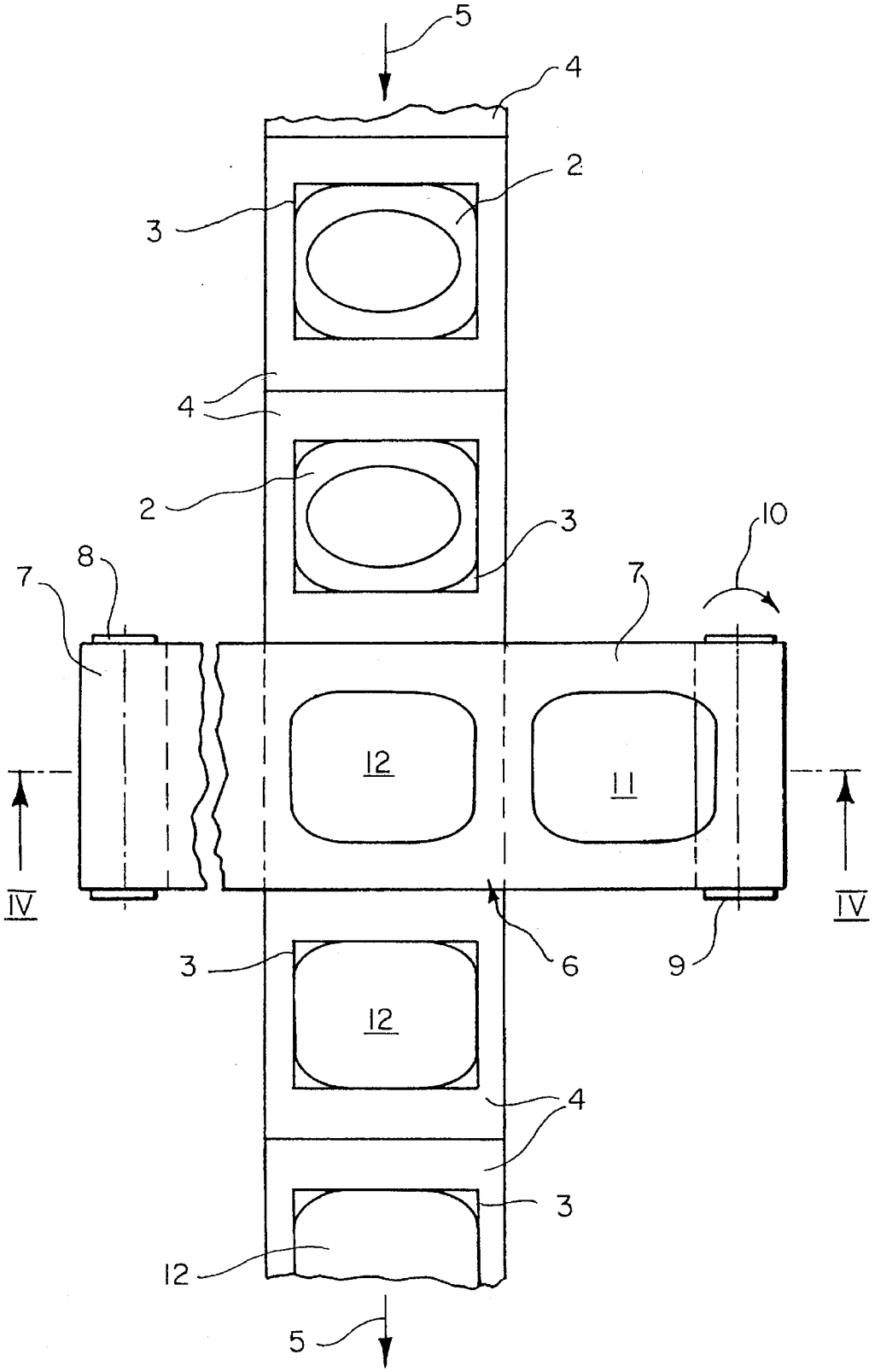

Further advantages, features and possibilities for use of the present invention will be shown in the following description together with the attached drawings. In these is shown in:

FIG. 1 a schematic and cut-away cross-sectional view through the filling point seen looking away from the first direction of conveyance of the conveyor belt, in a first operating step before filling, FIG. 2 a similar view to that in FIG. 1, however in a second operating step following the almost completed filling, FIG. 3 again a similar view, however in a third operating step after filling and forward movement of the web of covering foil, FIG. 4 again a similar view to that shown in FIGS. 1 to 3, in a fourth operating step after filling, punching out of the covering foil and sealing of the same, before the complete movement apart of the tools, and FIG. 5 a plan view of the filling point and the conveyor belt running from above to below on the one hand and the web of covering foil moveable from left to right on the other hand.

Essential parts of the individual tool units are known in themselves and are therefore only schematically represented here. The configuration of the package to be filled is also not critical. The package can be tub-like, cup-shaped or similarly configured and is in this case shown in FIGS. 1 to 4 with a rectangular cross-section, and in FIG. 5 as oval in plan view.

The package open on one side is designated with 1 and has an upper edge 2 to be closed, which is shown in FIG. 5. Such packages can, for example, be deep-drawn from plastics material and lie in a magazine which is not shown, from which they are taken and fitted into steel holders 3. These are located at exactly defined distances apart in a fixed manner on a steel conveyor belt 4 which moves from above to below in a first direction of conveyance 5 (see arrow 5) as shown in FIG. 5. In FIGS. 1 to 4 the steel conveyor belt 4 runs opposite to the direction of view of the observer. In FIGS. 1 to 4 which essentially show a cross-sectional view along the line IV—IV of FIG. 5, the steel conveyor belt 4 is shown schematically.

In FIG. 5 the filling point 6 is located where the steel conveyor belt 4 and the web of covering foil 7 cross over.

Figure 3:
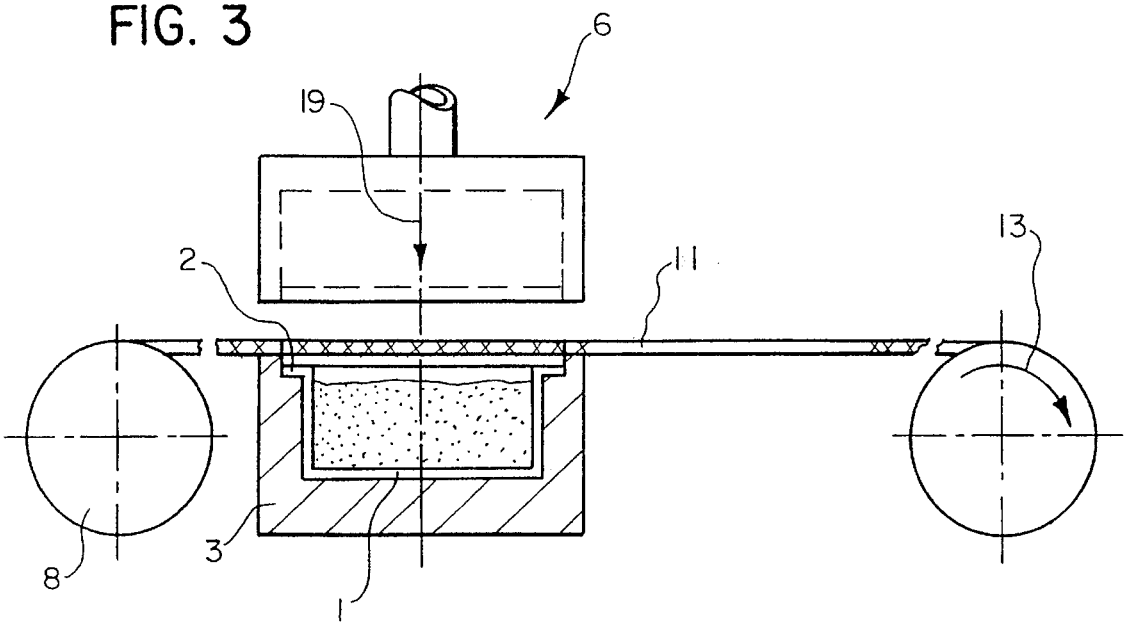

The web of covering foil 7 is conducted from a first roller 8 to a second roller 9 and can be moved intermittently in a second direction of movement 10 at an angle of 90° with respect to the first direction of conveyance 5 of the steel conveyor belt 4. The web of covering foil 7 without any holes or punched out sections is located on the first roll 8, while after punching out of the hole 11 to the size of the covering foil 12 the worked web of covering foil 7 is rolled onto the second roller 9 by rotation of the same in the direction of the curved arrow 13 (FIG. 3).

While FIG. 5 shows the plan view of the device and in particular the web of covering foil 7 crossing the conveyor belt 4 at the filling point 6, the stamping and sealing tool generally designated by 14 is shown in FIGS. 1 to 4 in different positions. It relates essentially to an upper position according to FIGS. 1 to 3 and a lower position according to FIG. 4, wherein the movement of the stamping and sealing tool 14 is vertical from above to below and from below to above. The external measurements of the stamping and sealing tool 14 match those of the steel holder 3 as the covering foil 12 corresponding to the size of the package 1 to be covered, including its edge 2, has to be punched out of the web of covering foil 7 and can then sealed on by means of the sealing tool.

In addition within the stamping and sealing tool 14 a filler pipe 15 is located which is moveable up and down with respect thereto, which also can also be moved up and down in the vertical direction but independently of the movement of the stamping and sealing tool 14 and is thus moveable relatively thereto. The possibility for movement of the filler pipe 15, the filling apparatus of which is known and therefore not shown here, extends from lowering of the bottom end 16 of the filler pipe 15 as far as the lower area of the package 1 to be filled (bottom) to an upwardly withdrawn position at a maximum distance away from the covering foil 12, as shown for example in FIG. 4.

In operation the filling and closing device in the configuration shown in the drawings and presently described works as follows.

Packages 1, open upwardly on one side with a flange-like outwardly extending edge 2 completely surrounding the upper opening of the package 1, are taken from a magazine which is not shown and fitted into holders 3 made of steel which are attached to a conveyor belt 4 at a fixed distance apart from one another and are intermittently moved in the first direction of conveyance 5 (FIG. 5) such that they are displaced from a position shown in FIG. 5 to a next position and are stopped there. Above the cross-over point in FIG. 5, where the web of covering foil 7 crosses the conveyor belt 4, two of these points are shown and viewed from above an empty package 1 with an oval cross-section and with the surrounding edge 2 can be seen, wherein the profile of the periphery of the holder 3 is also shown.

It assumed that the web of covering foil 7 is punched out to the size of a covering foil 12 at the cross-over point in the area of the filling point 6 and this covering foil 12 is sealed onto the edge 2 of the package 1. The web of covering foil 7 thus has a hole which is designated by 11 in the position horizontally to the right adjacent to the cross-over point, and through which the covering foil 12 can be seen at the cross-over point. This representation corresponds to the position in FIG. 4. The covering foil 12 is sealed onto the edge and thereafter the conveyor belt 4 moves along by one position in the direction of the first direction of conveyance 5, so that in FIG. 5 the closed package standing beneath the cross-over point can be seen, with a view of the covering foil 12.

During this forward movement of the filled and closed package the next package 1 is moved forward exactly underneath the cross-over position in the area of the filling point 6, as shown in a cross-sectional view in FIG. 1. The package 1 is still empty. Now the filler pipe 15 is lowered far enough for its bottom end 16 to arrive near to the base of the package 1, which is a movement in a vertically downward direction according to arrow 17. The contents are filled into the package 1, as shown in FIG. 2. This lowering of the filler pipe 15 according to the arrow 17 and the filling is done through the hole 11 in the web of covering foil 7 which is shown clearly in FIGS. 1 and After filling of the package 1 with a pre-determined amount of contents, the direction of movement of the filler pipe 15 is reversed, as is shown in FIG. 2, and it is withdrawn upwards in the direction of the upward pointing arrow 18 through the stamping and sealing tool 14. As soon as the bottom end 16 of the filler pipe 15 has left the interior of the package 1 and the hole 11 on the web of covering foil 7, the web of covering foil 7 is displaced in the second direction of movement 10 by one position to the right, so that the state shown in FIG. 3 is reached. The stamping and sealing tool 14 is now moved downwards in the vertical direction according to the arrow 19, so that the covering foil 12 is punched out of the web of covering foil 7, the result of which is shown in FIG. 4. With this, or immediately afterwards, the sealing of this covering foil 12 onto the edge 2 of the package 1 is carried out. In this way the web of covering foil 7 automatically has a hole 11 through which the filling in the subsequent step can be carried out. After punching out and sealing on of the covering foil 12 the stamping and sealing tool 14 is now withdrawn upwards in the direction of the arrow 20. The conveyor belt 4 with the holder 3 with the fitted, filled and closed package 1 can then be moved from the cross-over point in the first direction of conveyance 5 to one position further beneath (FIG. 5) as described in the introduction, so that the procedure is now repeated with respect to positioning.

We claim:

1. Method for filling and closing a package (1) open on one side having an edge therearound which everywhere carries sealable plastics material thereon, the method comprising the steps:

providing a means for conveying the package (1) intermittently in a first direction (5);

providing a filling point (6) for the package;

conveying the package to the filling point and bringing said package to a standstill;

providing a strip of covering foil material (7) at the filling point above the package (1) said strip having a hole (11) therethrough above the open side of the package and upstream of said hole having covering material of sufficient size to completely cover said open side and edge of said package;

filling the package through said hole;

providing means for moving the Strip (7) in a direction which has a substantial component lateral to the direction of conveyance of the package (1);

moving said strip of covering foil until the open side of the package (1) and the edge (2) therearound are completely covered by said strip of covering foil, and bringing said strip to a standstill;

providing means for punching out a covering piece (12) of foil from the strip thereof and punching out said piece (12);

providing means for sealing said covering piece onto the edge (2) and sealing said piece onto the edge (2); and moving the sealed package (1) along the first direction.

2. Method according to claim 1, wherein:

the hole (11) in the web of covering foil (7) is formed by punching out of a covering foil piece (12) during the sealing operation of the previous package.

3. Method according to claim 1, wherein:

a lid which stiffens the edge (2) of the package (1) is additionally applied to the package which is filled and closed with the covering foil piece (12).

4. Device for filling and closing a package (1) with a covering foil (12), said package being open on one side, said open side having an edge (2) therearound which everywhere carries sealable plastic material, said device comprising:

a conveyor belt (4) having holders (3) for receiving and conveying the package (1) in a first direction (5) to a filling point (6);

a pair of spaced apart parallel rollers (8, 9), roller (8) being adapted to carry an elongate spirally wound strip of covering foil material (7) and roller (9) to accept and wind said strip, said rollers being mounted so that said strip can be moved from roller (8) to roller (9) intermittently directly across and above the filling point (6) in a direction which has a substantial component lateral to said first direction (5), and at the approximate elevation of a topmost edge of the holder (3);

a stamping and sealing tool having a central vertical opening therethrough mounted vertically movable directly above the holder (3) at the filling point (6) above the strip of covering foil material (7), for cutting a package covering piece from the strip of foil material and sealing said covering piece to the edge (2) of the package (1) and leaving a hole in said strip of foil; and a filler pipe (15) mounted to be movable in a vertical direction (17, 19) at said filling point through the vertical opening through the tool and the hole in the covering material left from the previous covering operation.

5. Device according to claim 4, wherein:

the filler pipe (15) is mounted to be vertically movable along a path within a space bounded horizontally by the open side of the package (1), and is movable with respect to the stamping and sealing tool (14); and wherein the device further includes drive means for the conveyor (4), the roller (9), the filler pipe (15), and the stamping and sealing tool (14); and said drive means are matched synchronously with each other, so that the package is carried to the filling point, the filler pipe lowered through the hole in the covering foil from the previous operation, the package filled and the filler pipe retracted upwardly, the foil strip advanced to cover the package, the stamping and sealing tool lowered to punch out a foil cover and to seal said cover upon the package and retract vertically and the sealed package carried by the coveyor belt from the filling point, in automatic sequence.

6. Device according to claim 4, wherein the holders and belt are composed of steel; and the first direction of conveyance (5) is perpendicular to the second direction of movement (10).

7. Device according to claim 6, wherein:

in the first direction of conveyance (5) a lid fitting point is provided at a distance beyond the filling point (6).

8. Device according to claim 5, wherein:

the holder (3) and the conveyor belt (4) are composed of steel and the first direction of conveyance (5) is perpendicular to the second direction of movement (10).

9. Device according to claim 8, wherein:

in the first direction of conveyance (5) a lid fitting point is provided at a distance beyond the filling point (6).

10. Device according to claim 5, wherein:

in the first direction of conveyance (5) a lid fitting point is provided at a distance beyond the filling point (6).

11. Device according to claim 4, wherein:

in the first direction of conveyance (5) a lid fitting point is provided at a distance beyond the filling point (6).

12. Method according to claim 2, wherein:

a lid which stiffens the edge (2) of the package (1) is additionally applied to the package which is filled and closed with covering foil piece (12).

13. The device of claim 4 wherein the stamping and sealing tool comprises:

a punching member the shape and size of the open side and the edge (2) of the package (1), having a vertical opening therethrough above the open side of said package;

a vertically movable guide block having a cavity within which the punching member reciprocates vertically and a lowermost planar surface matching a topmost surface of the package holder, so that the foil strip (7) may be clamped between the holder (3) and the guide block and a covering piece of foil sheared from the strip by the punching member, said covering piece being sealed around edge (2) by continued downward motion of the punching member, said punching member and guide block being retractable vertically from the package after the covering operation.

* * * * *